US006933854B1

(12) United States Patent
Burgess

(10) Patent No.: US 6,933,854 B1
(45) Date of Patent: Aug. 23, 2005

(54) SECURITY BULB ASSEMBLY

(76) Inventor: Lorenzo Burgess, 833 Magnolia Creek Cir., Orlando, FL (US) 32828

( * ) Notice: Subject to any disclaimer, the term of this patent is extended or adjusted under 35 U.S.C. 154(b) by 90 days.

(21) Appl. No.: 10/407,043

(22) Filed: Apr. 4, 2003

(51) Int. Cl.[7] ..... G08B 23/00
(52) U.S. Cl. ..... 340/693.5; 340/691.1; 340/693.6; 340/693.12
(58) Field of Search ..... 340/693.5, 693.6, 340/555, 556, 557, 565, 566, 567, 548, 691.1, 340/693.9, 693.12; 362/226, 419

(56) References Cited

U.S. PATENT DOCUMENTS 4,716,402 A * 12/1987 Francis ..... 340/546
4,730,184 A * 3/1988 Bach ..... 340/691.5
4,812,827 A 3/1989 Scripps
D360,157 S 7/1995 Sandell et al.
5,619,185 A 4/1997 Ferraro
5,650,773 A 7/1997 Chiarello
5,890,797 A * 4/1999 Bish ..... 362/419
6,049,274 A 4/2000 Stachurski
6,696,971 B2 * 2/2004 Tukin ..... 340/693.5
6,741,176 B2 * 5/2004 Ferraro ..... 340/568.1

* cited by examiner

*Primary Examiner*—Van T. Trieu

(57) ABSTRACT

A security bulb assembly for providing a user with a home or building security device that would allow a user to convert an existing motion detector security light into a combination security light and audible alarm. The security bulb assembly includes a main housing having a pair of sockets. A mounting assembly is coupled to the main housing whereby the main housing is adapted to be mounted to a support structure. An audible alarm assembly is coupled to one of the sockets of the main housing. A light coupled to a second one of the sockets of the main housing. A motion sensor is coupled to the main housing. The motion sensor is operationally coupled to each of the sockets for sending an electrical current to each of the sockets thereby activating the audible alarm assembly and illuminating the light upon detection of motion by the motion sensor.

10 Claims, 4 Drawing Sheets

SECURITY BULB ASSEMBLY

BACKGROUND OF THE INVENTION

1. Field of the Invention

The present invention relates to security alarm assemblies and more particularly pertains to a new security bulb assembly for providing a user with a home or building security device that would allow a user to convert an existing motion detector security light into a combination security light and audible alarm.

2. Description of the Prior Art

The use of security alarm assemblies is known in the prior art. U.S. Pat. No. 6,049,274 describes a portable system for being installed in a conventional light socket. Another type of security alarm assembly is U.S. Pat. No. 5,619,185 describes a flood light lamp removal alarm that activates an alarm when the flood lights are removed from their socket. U.S. Pat. No. 5,890,797 describes a multi-directional security light with an elongated extension arm. U.S. Pat. No. 4,812,827 describes a detector and light assembly. U.S. Pat. No. 5,650,773 describes a multi-function intrusion warning system. U.S. Pat. No. Des. 360,157 describes a design for a motion sensor head.

While these devices fulfill their respective, particular objectives and requirements, the need remains for a device that includes an audible alarm with an adjustable volume control.

SUMMARY OF THE INVENTION

The present invention meets the needs presented above by providing an audible alarm assembly that is operationally coupled to a socket. Typically, the socket is part of an existing light system.

An object of the present invention is to provide an adjustable volume control to adjust the volume of a speaker in the audible alarm assembly.

Another object of the present invention is to provide a new security bulb assembly that could be used in standard light bulb socket, particularly any dual lamp motion detector security light.

Still another object of the present invention is to provide a new security bulb assembly that would require no additional wiring or complicated installation.

To this end, the present invention generally comprises a main housing having a pair of sockets. A mounting assembly is coupled to the main housing whereby the main housing is adapted to be mounted to a support structure. An audible alarm assembly is coupled to one of the sockets of the main housing. A light coupled to a second one of the sockets of the main housing. A motion sensor is coupled to the main housing. The motion sensor is operationally coupled to each of the sockets for sending an electrical current to each of the sockets thereby activating the audible alarm assembly and illuminating the light upon detection of motion by the motion sensor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
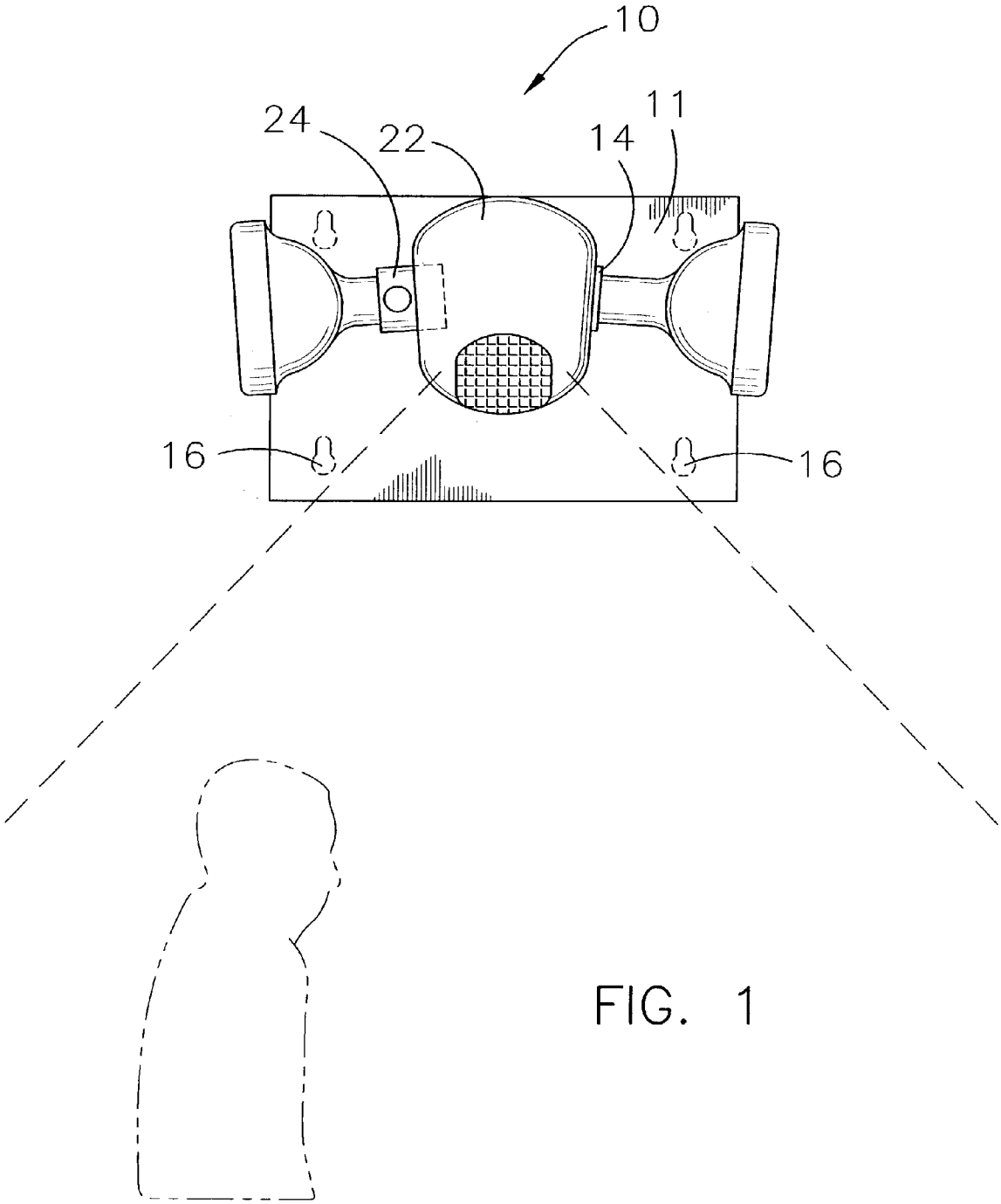
FIG. 1 is an in-use view of a new security bulb assembly according to the present invention.
Figure 2:
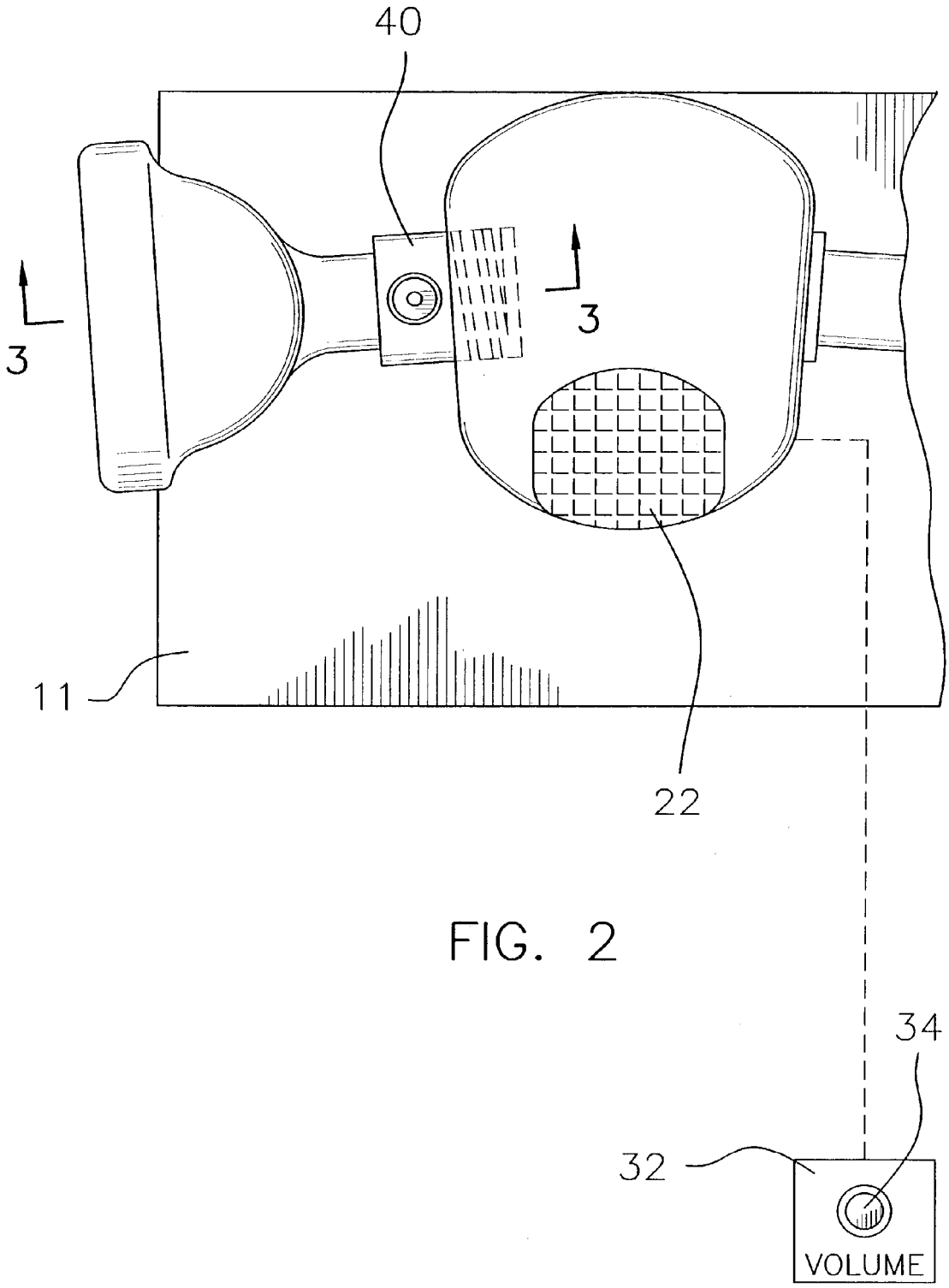
FIG. 2 is a front view of the present invention.
Figure 3:
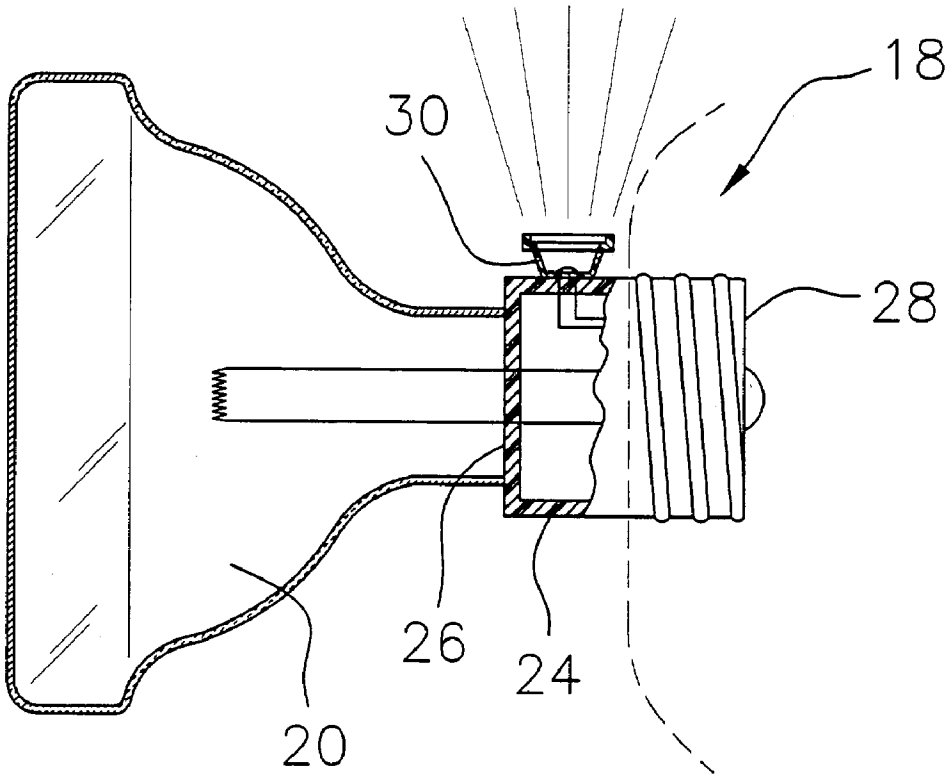
FIG. 3 is a cross-sectional view of the present invention.
Figure 4:
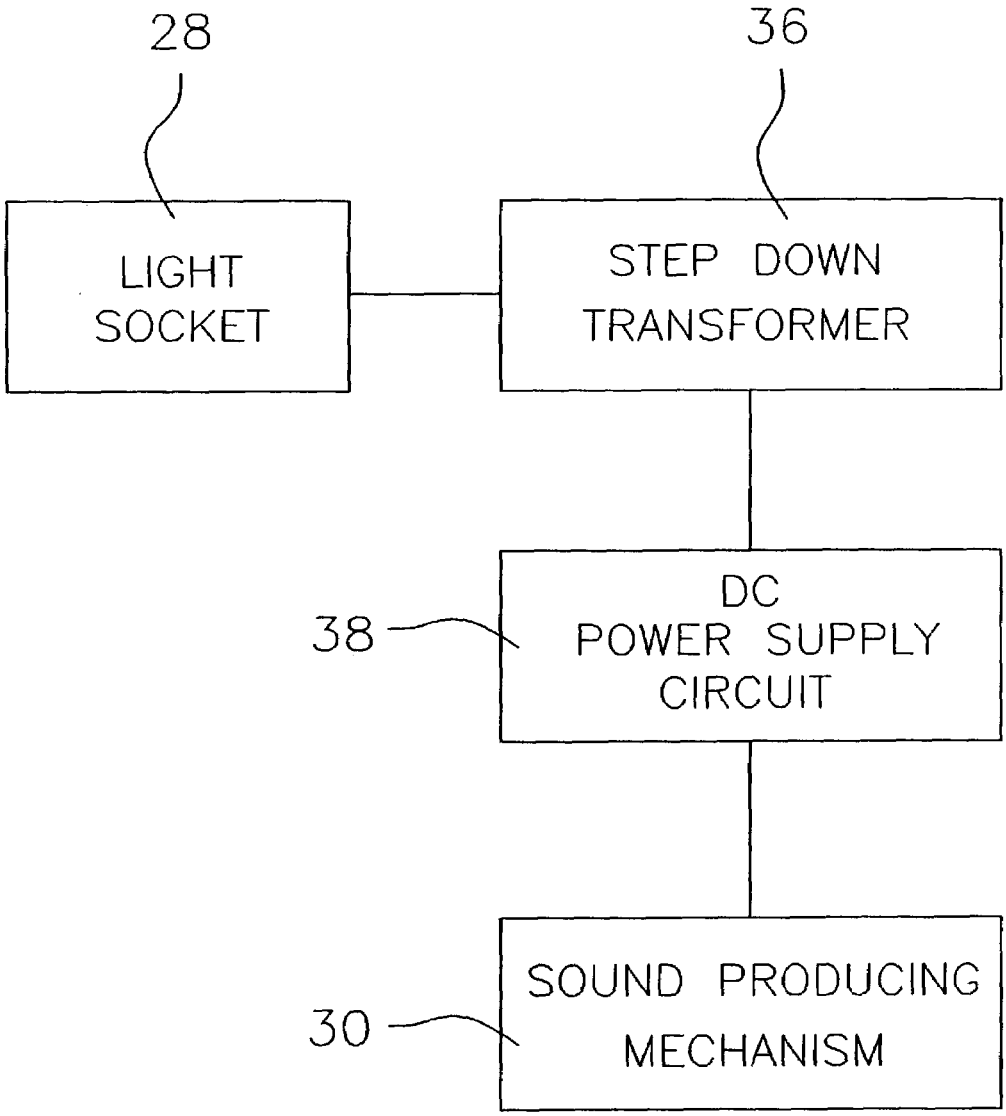
FIG. 4 is an end view of the audible alarm assembly of the present invention.

With reference now to the drawings, and in particular to FIGS. 1 through 4 thereof, a new security bulb assembly system embodying the principles and concepts of the present invention and generally designated by the reference numeral 10 will be described.

As best illustrated in FIGS. 1 through 4, the security bulb assembly system 10 generally comprises a main housing 12 having a pair of sockets 14. A mounting assembly 16 is coupled to the main housing 12 whereby the main housing 12 is adapted to be mounted to a support structure. An audible alarm assembly 18 is coupled to one of the sockets 14 of the main housing 12. A light 20 coupled to a second one of the sockets 14 of the main housing 12. A motion sensor 22 is coupled to the main housing 12. The motion sensor 22 is operationally coupled to each of the sockets 14 for sending an electrical current to each of the sockets 14 thereby activating the audible alarm assembly 18 and illuminating the light 20 upon detection of motion by the motion sensor 22.

The audible alarm assembly 18 includes an audible alarm housing 24 that is shaped to resemble the flood light 20. The audible alarm housing 24 has an open end 26 and a socket end 28. The socket end 28 is engageable to the one of the sockets 14 of the main housing 12. A sound producing mechanism 30 is positioned in the open end 26 of the audible alarm housing 24. The sound producing mechanism 30 is operationally coupled to the socket end 28 of the audible alarm housing 24 whereby the sound producing mechanism 30 transmits an audible sound upon the motion sensor 22 sending electrical current to the one of the sockets 14 of the main housing 12. A cover having a plurality of openings 58 may cover the open end 26.

A volume control mechanism 32 is positioned in the audible alarm housing 24. The volume control mechanism 32 is operationally coupled to the sound producing mechanism 30 for permitting adjustment of a volume level of the audible sound transmitted by the sound producing mechanism 30. The volume control adjustment mechanism 32 includes a volume control knob 34 that extends through the audible alarm housing 24 to permit manual adjustment of the volume level while the audible alarm housing 24 is engaged to the one of the sockets 14 of the main housing 12.

A step down transformer 36 and a DC power supply circuit 38 are positioned in the audible alarm housing 24. The step down transformer 36 and the DC power supply circuit 38 are operationally coupled between the socket end 28 of the audible alarm housing 24 and the sound producing mechanism 30 for providing a DC current to activate the sound producing mechanism 30 when the motion sensor 22 provides electrical current to the one of the sockets 14 of the main housing 12. The volume control adjustment mechanism 32 has low, medium and high volume settings.

In an embodiment the sound producing mechanism 30 is a piezo-electric buzzer 40. A step down transformer 36 and a DC power supply circuit 38 are positioned in the audible alarm housing 24. The step down transformer 36 and the DC power supply circuit 38 are operationally coupled between the socket end 28 of the audible alarm housing 24 and the piezo-electric buzzer 40 for providing a DC current to activate the piezo-electric buzzer 40 when the motion sensor 22 provides electrical current to the one of the sockets 14 of the main housing 12.

In use, the present invention would simply be screwed into one light socket of a dual-lamp motion detector security light, thereby converting it into a combination security light and alarm combination. The user would then set the alarm volume to the desired level.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A security alarm assembly comprising:

a main housing having at least one socket configured for receiving a conventional light bulb threaded base;

mounting means on said main housing for mounting said housing to a support structure;

an audible alarm assembly removably coupled to said at least one socket of said main housing, said audible alarm assembly comprising:

an alarm housing having a substantially hollow interior, said alarm housing having a horn shape with a relatively smaller socket end and a relatively larger open end, said socket end having exterior threads formed thereon which removably engage the at least one socket of the main housing assembly; and a sound producing mechanism positioned in said open end of said interior of said substantially hollow horn-shaped alarm housing, said sound producing mechanism being operationally coupled to said socket end of said alarm housing such that said sound producing mechanism transmits an audible sound upon said at least one socket receiving electrical current;

a motion sensor coupled to said main housing, said motion sensor being operationally coupled to said at least one socket for sending an electrical current to said at least one socket upon detection of motion by said motion sensor and thereby activating said audible alarm assembly.

2. The security alarm assembly of claim 1, wherein said alarm housing of said audible alarm assembly is shaped to resemble a light.

3. The security alarm assembly of claim 1, further comprising:

a volume control mechanism positioned on said audible alarm housing, said volume control mechanism being operationally coupled to said sound producing mechanism for permitting adjustment of a volume level of said audible sound transmitted by said sound producing mechanism.

4. The security alarm assembly of claim 3, wherein said volume control adjustment mechanism includes a volume control knob extending through said audible alarm housing to permit manual adjustment of the volume level while the audible alarm housing is engaged to said one of said sockets of said main housing.

5. The security alarm assembly of claim 4, wherein said volume control adjustment mechanism has low, medium and high volume settings.

6. The security alarm assembly of claim 1, wherein said at least socket of said main housing includes two sockets, said audible alarm assembly being mounted on a first one of said two sockets; and further comprising:

a light bulb mounted on a second one of said to sockets.

7. The security alarm assembly of claim 1 wherein said sound producing mechanism comprises a piezo-electric buzzer; and a step down transformer positioned in the substantially hollow interior of said audible alarm housing, said step down transformer being operationally coupled between said socket end of said audible alarm housing and said piezo-electric buzzer for providing a DC current to activate said piezo-electric buzzer when said motion sensor provides electrical current to said one of said sockets of said main housing.

8. The security alarm assembly of claim 1, further comprising:

a step down transformer positioned in said audible alarm housing, said step down transformer being operationally coupled between said socket end of said audible alarm housing and said sound producing mechanism for providing a DC current to activate said sound producing mechanism when said motion sensor provides electrical current to said at least one socket of said main housing.

9. The security alarm assembly of claim 1, wherein said alarm housing of said audible alarm assembly is shaped to resemble a light;

a volume control mechanism positioned on said audible alarm housing, said volume control mechanism being operationally coupled to said sound producing mechanism for permitting adjustment of a volume level of said audible sound transmitted by said sound producing mechanism;

wherein said volume control adjustment mechanism includes a volume control knob extending through said audible alarm housing to permit manual adjustment of the volume level while the audible alarm housing is engaged to said one of said sockets of said main housing;

wherein said at least socket of said main housing includes two sockets, said audible alarm assembly being mounted on a first one of said two sockets;

a light bulb mounted on a second one of said to sockets;

wherein said sound producing mechanism comprises a piezo-electric buzzer; and a step down transformer positioned in the substantially hollow interior of said audible alarm housing, said step down transformer being operationally coupled between said socket end of said audible alarm housing and said piezo-electric buzzer for providing a DC current to activate said piezo-electric buzzer when said motion sensor provides electrical current to said one of said sockets of said main housing; and wherein said volume control adjustment mechanism has low, medium and high volume settings.

10. A security alarm assembly comprising:

an audible alarm assembly for removably coupling to a conventional light bulb socket, said audible alarm assembly comprising:

an alarm housing having a substantially hollow interior, said alarm housing having a horn shape with a relatively smaller socket end and a relatively larger open end, said socket end having exterior threads formed thereon which are configured to removably engage the conventional light bulb socket; and a sound producing mechanism positioned in said open end of said interior of said substantially hollow horn-shaped alarm housing, said sound producing mechanism being operationally coupled to said socket end of said alarm housing such that said sound producing mechanism transmits an audible sound upon said at least one socket receiving electrical current;

wherein said alarm housing of said audible alarm assembly is shaped to resemble a conventional flood light bulb.

* * * * *